United States Patent [19]

Ball et al.

[11] Patent Number: 4,874,255

[45] Date of Patent: Oct. 17, 1989

[54] TOP GUSSET BAG WITH INTEGRAL HANDLE

[75] Inventors: James R. Ball, Kent; Delbert J. Barnard, Federal Way, both of Wash.

[73] Assignee: Cello Bag Company, Inc., Seattle, Wash.

[21] Appl. No.: 278,785

[22] Filed: Dec. 2, 1988

[51] Int. Cl.[4] ..... B65D 33/10

[52] U.S. Cl. ..... 383/8; 383/29

[58] Field of Search ..... 383/10, 8, 7, 6, 21, 383/25, 29

[56] References Cited

U.S. PATENT DOCUMENTS

| | | | |
|---|---|---|---|
| 3,378,190 | 4/1963 | White | 383/7 X |
| 4,149,339 | 4/1979 | Hall et al. | 383/8 X |
| 4,721,396 | 1/1988 | Sengewald | 383/8 |
| 4,738,546 | 4/1988 | Sengewald | 383/8 X |

FOREIGN PATENT DOCUMENTS

| | | | |
|---|---|---|---|
| 293995 | 12/1988 | European Pat. Off. | 383/10 |
| 3644618 | 7/1988 | Fed. Rep. of Germany | 383/7 |
| 1516010 | 3/1968 | France | 383/10 |
| 2570352 | 3/1986 | France | 383/10 |

*Primary Examiner*—Stephen P. Garbe
*Assistant Examiner*—Jes F. Pascua
*Attorney, Agent, or Firm*—Delbert J. Barnard

[57] ABSTRACT

A false gusset (12, 82) is positioned between bag panels (26, 28 or 98, 100) to form a bag having a handle (24, 80) at its upper end formed by upward continuations of the sides (26, 28 or 98, 100) of the bag (10, 78). This construction removes the false gusset (12, 82) and the seals (66, 68 or 114, 116) which connect the false gusset (12, 82) to the bag panels (26, 28 or 98, 100) from the forces created by the weight of the bag (10, 78).

15 Claims, 6 Drawing Sheets

78
80
82
84
86
88
90
92
94
96
98
100
102
106
108
110
112
114
116
118
120
122
132
136
138
140
142

Fig.15
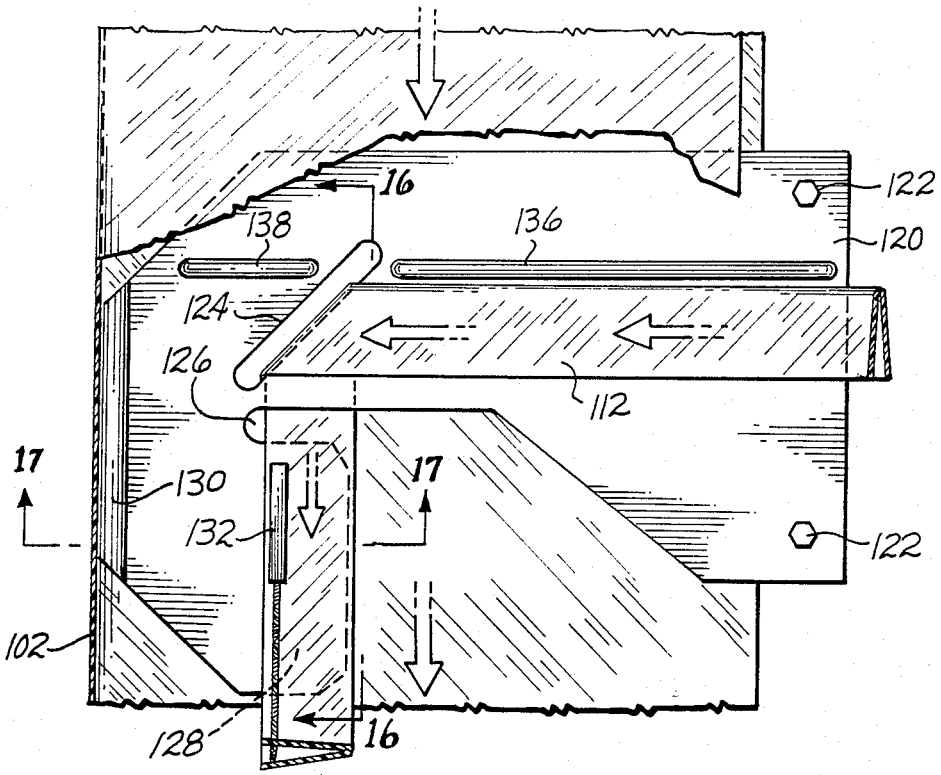
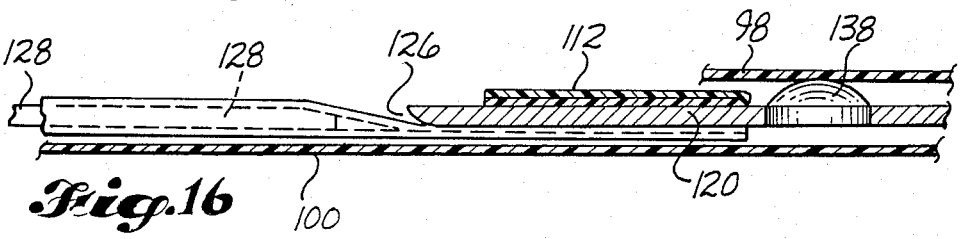
Fig.16
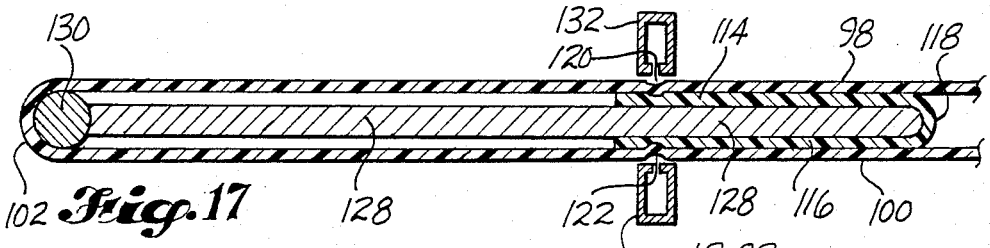
Fig.17
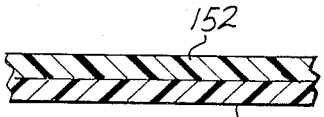
Fig.18
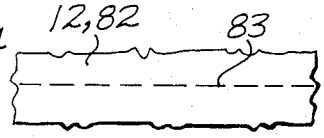
Fig.19

TOP GUSSET BAG WITH INTEGRAL HANDLE

DESCRIPTION

1. Technical Field

This invention relates to bottom loaded plastic bags which have a closed top and a carton look when filled. More particularly, it relates to the provision of such a bag with a side-to-side carrying handle which is an integral part of the side panels of the bag.

2. Background Art

It is known to construct a plastic bag by folding a continuous web of thermoplastic material over on itself, then making an infold at the folded edge, to form a gusset, and then simultaneously cutting and heat sealing the folded web along spaced apart transverse lines. Each individual bag formed in this manner has a "M" shaped cross section at the gusset. Bags constructed in this manner are inherently capable of assuming a substantially hexahedron shape when filled with a proper quantity of a particular type of goods. This type of bag is commonly referred to as a "bread bag" and is used for packaging loaves of bread. The bread loaf is inserted into the bag through an open end that is opposite the gusset. The open end is then tied shut in an appropriate manner.

It is also known to provide bags of this type with an add-on handle at the closed or gusset end of the bag. By way of an example, French Patent Publication No. 2,053,590, published in 1971, by inventor Christen Huni, discloses an add-on handle which extends transversely across the gusset end of the bag. The opposite ends of the handle include flanges which are heat welded to the opposite sidewalls of the bag substantially where they are joined to the top or gusset of the bag.

It is also known to make a handle bag of this general type in which the handle member is made long enough so that a person's arm can be fitted between it and the gusset, enabling the bag to be carried on the arm if a user desires to carry the bag in this manner. Such a bag is disclosed by U.S. Pat. No. 4,573,203, granted Feb. 25, 1986, to Harry R. Peppiatt.

A disadvantage of a bag of this type is that the handle is an add-on handle and a heat seal must be provided between the bag body and the handle through which forces are transmitted during the carrying of the bag and its contents. The attached end portions of the handle side laps the sidewalls of the bag material and the tension forces in the film must "jog" through the heat seal as they are transferred from the sidewalls of the bag to the handle. The tension forces want to pull the bag film and the handle film into a single plane but this is not possible. What happens is that the lower edge portion of the handle, which depends from the seal line, flares outwardly somewhat from the sidewalls of the bag. Also, the process used for connecting the handle to the sidewalls puckers the connecting edge and in effect pleats the depending edge portion. Another problem is that the exposed lower boundary of the handle is quite often irregular. This irregular boundary, the vertical pleats in the depending edge, and the bending up of the edge from the bag walls combine to produce a relatively unattractive juncture between the handle and the bag body.

A principal object of the present invention is to provide a bag construction characterized by bag sidewalls which continue upwardly over a closed top to form a handle. The handle is a continuation of the sidewall material and as a result the handle connection is in the same plane with the bag sidewalls at the juncture between the sidewalls and the handle. Also, there is no depending edge portion of the handle, resulting in a much neater appearing transition between the bag sidewalls and the handle.

It is known to construct packaged bags which have sidewalls which merge into the handle. However, these bags are open top bags. An example of such a bag is disclosed by U.S. Pat. No. 3,580,486, granted May 25, 1971, to Emanuel Kugler.

It is known to construct a plastic bag to include both a gusset and opposite side handle portions at its upper end. The bag is end folded an amount to form both a gusset and handle portions which project above the gusset. The folded end portions are heat sealed along parallel lines which are vertically positioned between the center fold of the gusset and fold lines formed at the upper boundary of the bag. A bag of this type is disclosed by Canadian Patent No. 907,574, granted Aug. 15, 1972 to Herbert F. Gerband. One problem of this type of construction is that it requires the use of more material than is necessary in the construction of the bag. Also, it results in a pair of grip handles on opposite sides of the bag which may not be desirable for some uses.

Another object of the present invention is to provide a bag constructed to assume a substantially hexahedron shape when filled which includes a side-to-side continuous handle which is formed from the pieces of material which form the sidewalls of the bag, and which includes a closed top formed from a separate piece of material.

DISCLOSURE OF THE INVENTION

According to the invention, a handle bag is provided which comprises first and second panels of a flexible thermoplastic material. The panels overlie one another and together present an upper boundary and a lower boundary. A web of thermoplastic material is folded on itself to form two web sections joined by a bight and two edges near each other opposite the bight. The folded web is positioned between the two panels with the bight directed towards the lower boundary of the panels and the edges spaced from the upper boundary a distance at least as large as the folded width of the web. The edge portions of the web section are heat sealed to adjoining portions of the two panels. The connection of the web edge portions to the panels is along lines which extend parallel to the bight and the edges of the web and also parallel to the upper and lower boundaries of the panel. Heat seals seal the panels and the folded web together along spaced apart lines which extend parallel to each other and perpendicular to the bight and the edges of the folded web and also perpendicular to the upper and lower boundaries of the panels. These heat seals form bag side seals which connect together the two sections of the folded web and the adjoining portions of the two panels, in the region where the folded web is between the two panels. The side seals also connect the two panels together in the region of the panels which extends between the bight of the folded web and the lower boundary of the panel. The panels are connected to each other and to the folded web by the heat seals in a manner so that the bag when filled can approximate the shape of a hexahedron, with the web unfolded to form a closed top of the bag. The panels are connected together at the upper boundary of the panels. The portions of the panels that are located between the outer boundary of the panels and the heat seals which connect the web to the panels form a handle which extends over the closed top of the bag, from one side of the bag to the other.

According to the invention, the first and second panels can be separate members which are connected together at the upper boundary of the panels by heat seal, or such panels may be constructed from a single piece of material that is folded on itself to form an integral connection at the upper boundary of the panels.

The present invention also includes the methods of manufacturing the two forms of bag which have been described.

Other objects, advantages and features of the invention will be hereinafter described as a part of the description of the best mode.

BRIEF DESCRIPTION OF THE DRAWINGS

In the drawing, like reference numerals designate like parts throughout the several views, and:

FIG. 15 is a view of the upper portion of FIG. 14, with the foreground portion of the bag material omitted;

FIG. 16 is an enlarged scale sectional view taken substantially along line 16—16 of FIG. 15;

FIG. 17 is an enlarged scale fragmentary sectional view taken view taken substantially along line 17—17 of FIG. 15;

FIG. 18 is a fragmentary sectional view of the bag web showing the use of a laminated web material; and FIG. 19 is a fragmentary plan view of a region of the gusset, showing an easy opening structure in the form of a line of perforations.

BEST MODE FOR CARRYING OUT THE INVENTION

Figures 1, 2:
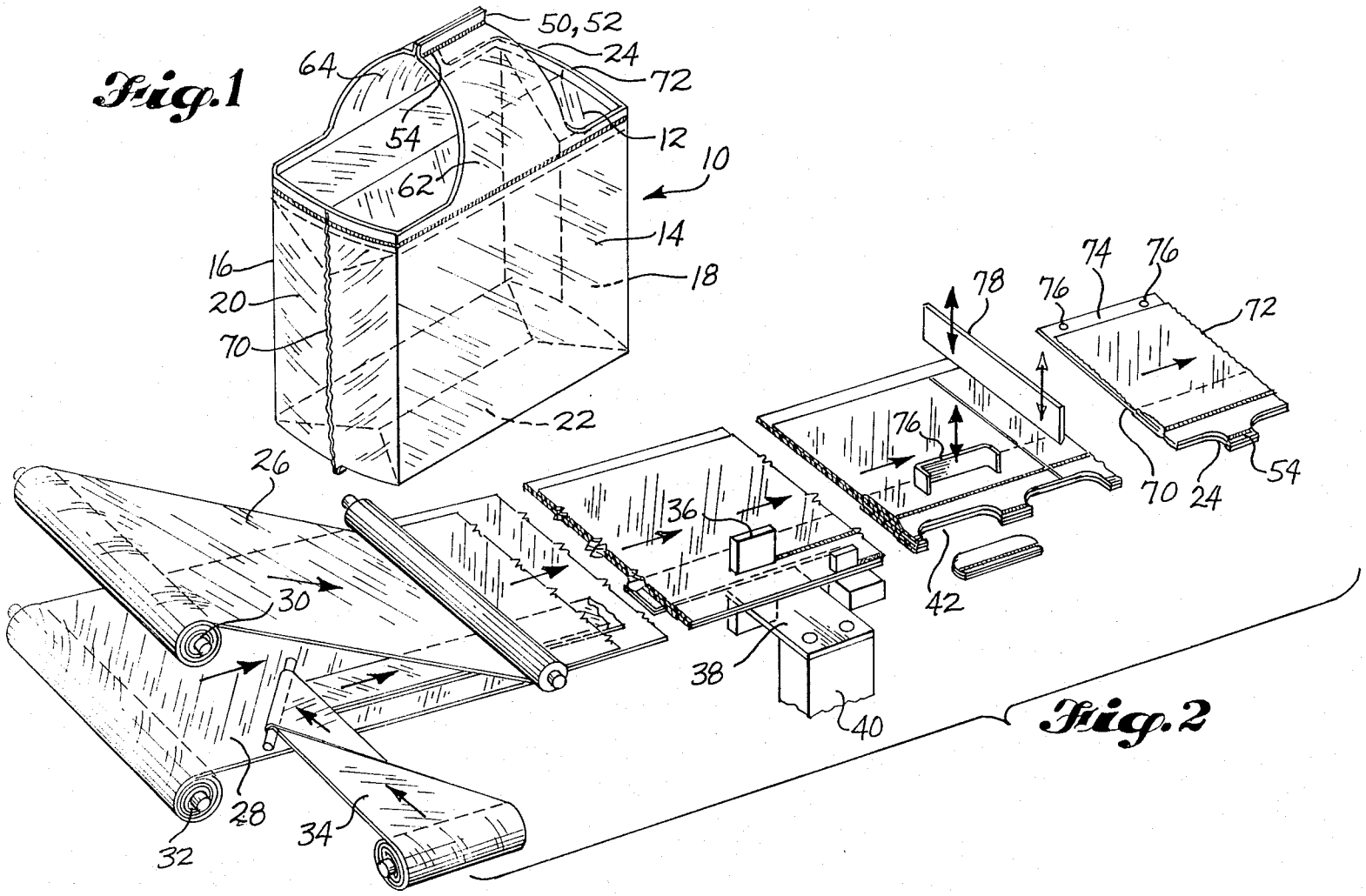
FIG. 1 is a pictorial view of a first embodiment of the present invention in a filled condition, such view being taken from above and looking towards the top, one end and one side of the bag.
FIG. 2 is a pictorial schematic view of the process of manufacturing the bag shown by FIGS. 1.

Referring to FIG. 1, bag 10, in a filled condition, comprises a top 12, opposite sides 14, 16, opposite ends 18, 20, a bottom 22 and a handle 24. Preferably, bag 10 is used as a package for products (e.g. disposable diapers) which can be snugly packed into the bag 10. Owing to its construction, bag 10 takes on a "carton" like appearance when snugly packed.

Referring to FIG. 2, the bag 10 may be manufactured in the following manner. An upper bag panel web 26 and a lower bag panel web 28 are fed from storage rolls 30, 32 through a bag making machine. A false gusset web 34 is folded laterally on itself and is introduced between the bag panel webs 26, 28 to move with them longitudinally through the bag forming machine. The false gusset web 34 may be folded in any suitable manner, such as by use of a V-board, or the like, and can be suitably guided after it is folded into a precise position relative to the bag panel webs 26, 28. The false gusset web 34 and the bag panel webs 26, 28 are heat sealed together, either while the webs 24, 26, 28 are moving or while they have been stopped momentarily.

Figure 6:
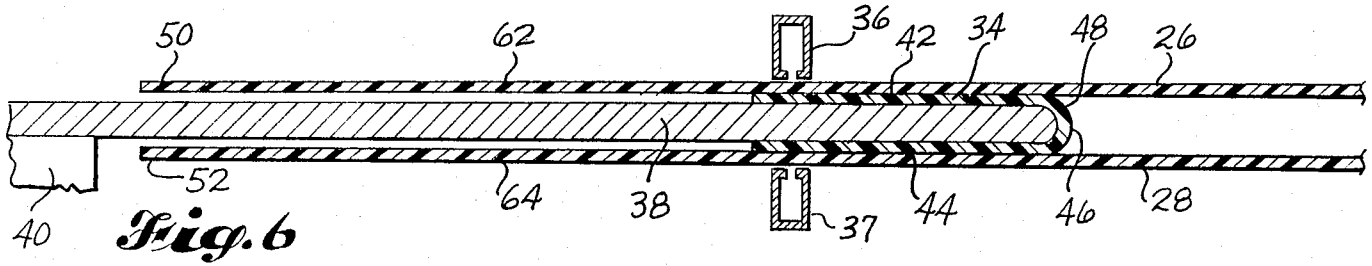
FIG. 6 is an enlarged scale sectional view showing the false gusset in the process of being heat sealed to the opposite side panels of the bag.

FIG. 2 diagrammatically shows an upper heat sealing implement 36 in the process of sealing together the webs 34, 26, 28 as they are traveling. FIG. 6 shows the upper sealing implement 36, and a companion lower heat sealing implement 37, in the form of hot air manifolds, positioned for delivering hot air to the regions of the webs 34, 26, 28 which are to be heat sealed together. In FIG. 6 the folded false gusset web 34 is shown to be guided by a guide board 38 which is suitably anchored at its outer end to a frame portion 40 of the bag making machine. Guide board 38 also functions to prevent the upper and lower web sections 42, 44 from being heat sealed together. The inner end 46 of the guide board 38 is preferably rounded where it makes contact with the bight 48 of the folded web 34. A bearing surface or an air bearing may be provided at end 46 to lessen the friction forces between the web 34 and board 38. Or, the end 46 may be spaced away from contact with the bight 48.

Figure 7:
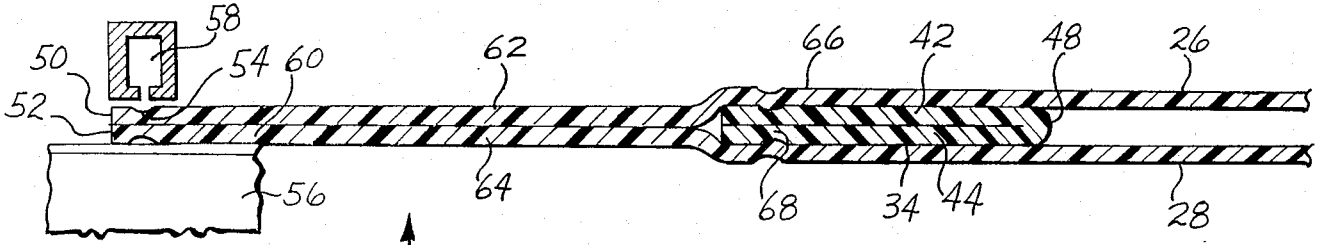
FIG. 7 is a view like FIG. 6, showing the upper end portions of the bag panels being heat welded together.

Following connection of the false gusset web 34 to the bag panel webs 26, 28 and the upper boarder portions 50, 52 of the bag panel webs 26, 28 are heat welded or otherwise secured together at 54. In FIG. 7 the web portions 50, 52 are shown to be supported by a guide member 56 and a hot air manifold 58 is shown in the process of delivering a stream of hot air against the two web portions 50, 52 to form the heat seal 54. Guide member 56 may be a stationary member having a TEFLON (trademark) layer 60 or a similar heat resistant material. Or, it may be a roller over which the traveling webs 34, 26, 28 extend, with the layer 60 being either a surface portion of the roller or a stationary strip positioned between the plastic material and the roller.

Figure 5:
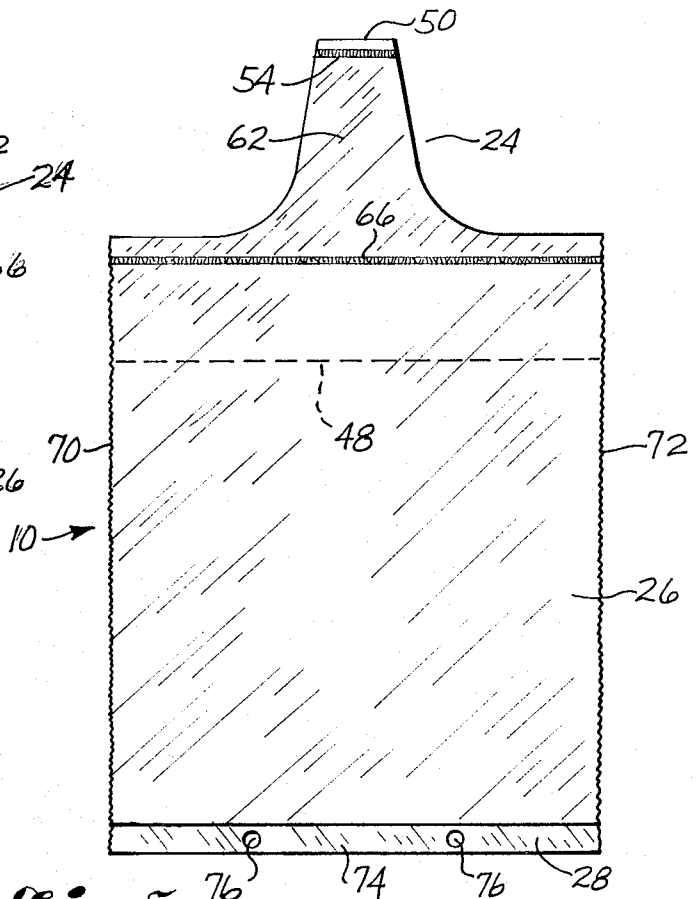
FIG. 5 is a side view of a full bag in a flat condition.
Figure 4:
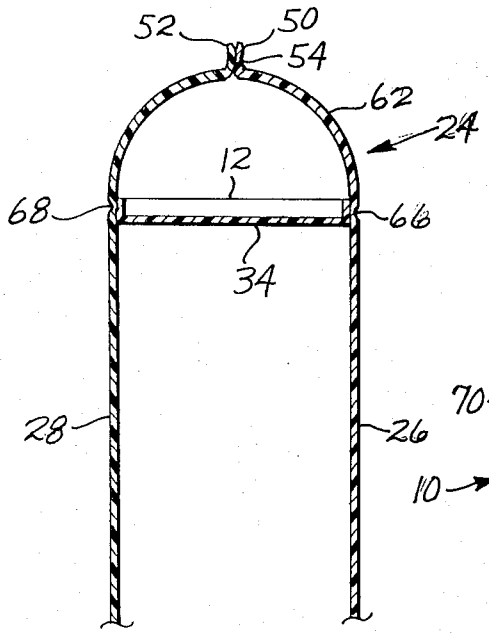
FIG. 4 is a view like FIG. 3, but with the bag in its filled out condition.
Figure 3:
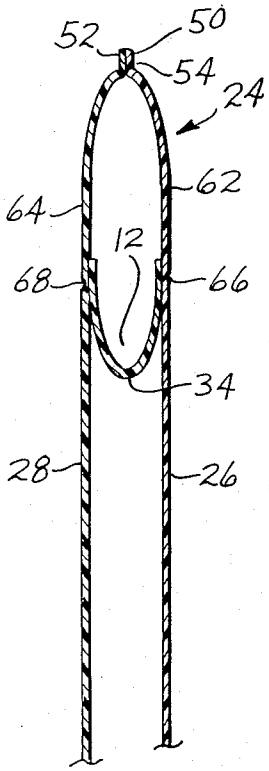
FIG. 3 is a sectional view taken through the bag of FIG. 1, in an unfilled position, but with a space being shown between its parts, and with its bottom cut away.

After the false gusset web 34 has been connected to the two bag panel webs 26, 28 and preferably also after the web portions 50, 52 have been heat sealed together at 54, the portions 62, 64 of the side panel webs 26, 28 which extend laterally between the heat seals 54 and 66, 68 are cut so as to delineate a handle shape (e.g. the handle shape shown in FIGS. 1 and 5). At the same time, or as a separate operation, individual bags 10 are delineated from the joined together webs 34, 26, 28. As is well known per se, the cutting of the webs 34, 26, 28 to delineate the bags 10 forms side seals 70, 72 which extend lengthwise of the bag 10, at each of its side edges.

The handle shape forming requires the making of a single cut-out 74. This cut-out may be made by a heated knife, a punch-type cutter, a traveling blade knife, etc. The bags 10 may be cut free from the webs 34, 26, 28 by means of a hot knife 78. When the knife 78 is moved downwardly it both cuts the webs 34, 26, 28 and heat seals the material together to form the side seams 70, 72.

As is known per se, one of the bag panel webs (e.g. web 26) may be slightly narrower than the other bag panel web such that a lip 74 is formed at the open end of the bag. Wicket pin openings 76 are formed in the lip 74. These openings may be punched at the same time that the handle cut-out unit 76 is being used for forming the handle cut-out 74.

As is well known to persons skilled in the art, the bag machine includes mechanism for creating slack in the webs 34, 26, 28 between the inflow section of the machine in which the webs 34, 26, 28 are continuously moving and the outflow section of the machine in which the webs are intermittently stopped so that the cutters 76, 78 and the wicket pin hole punches can be operated. Also omitted from the drawing are the feed rolls which move the webs and which help the guiding of the webs through the region where the heat seals 54, 66, 68 are formed.

Figures 10, 11, 12, 13:
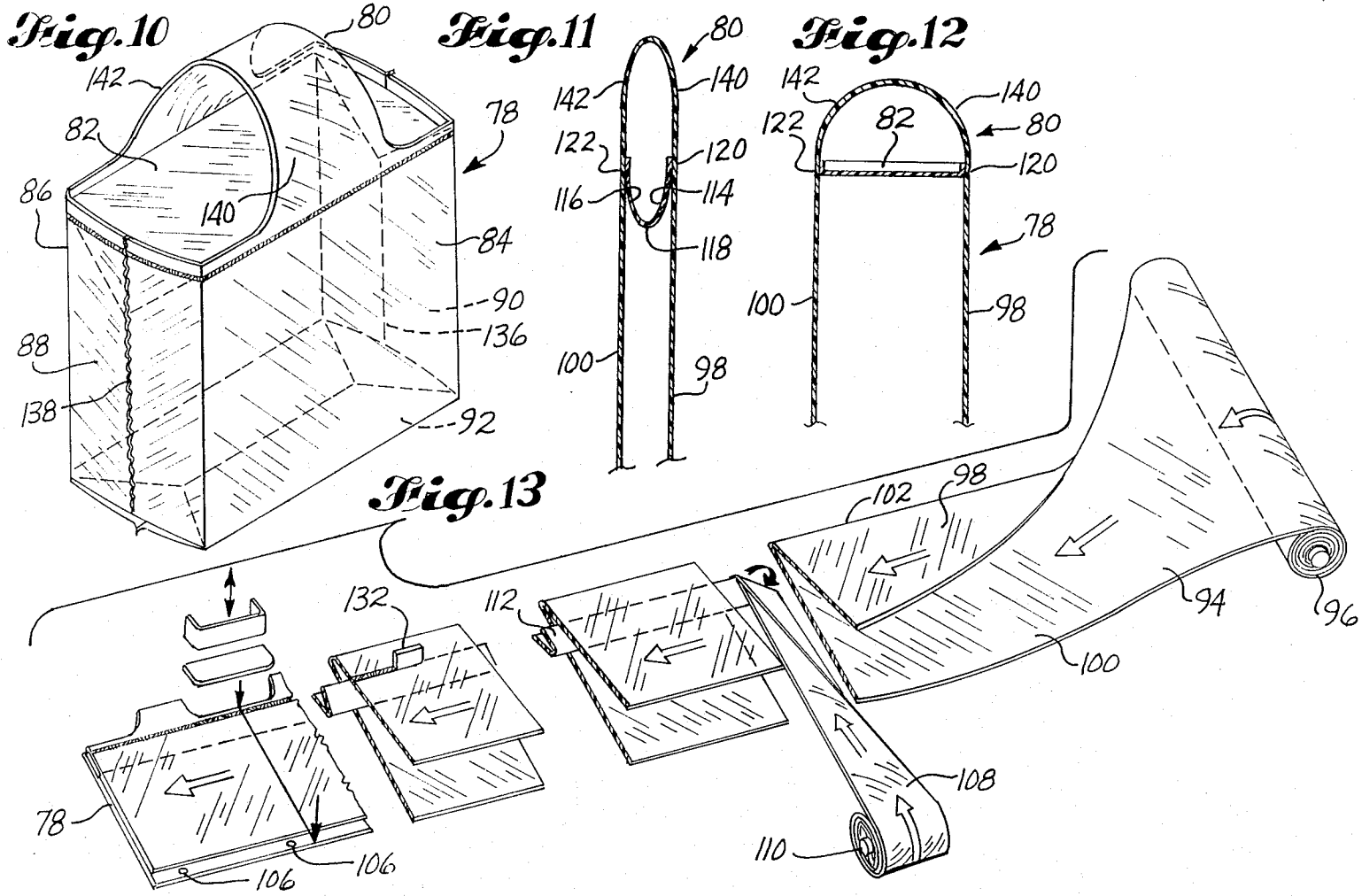
FIG. 10 is a view like FIG. 1, but of a modified embodiment.
FIG. 11 is a view like FIG. 3, but of the embodiment of FIG. 10.
FIG. 12 is a view like FIG. 4, but of the embodiment shown by FIG. 10.
FIG. 13 is a view like FIG. 2, but showing the process used to manufacture the embodiment shown by FIGS. 10–12.

FIGS. 10–12 show a second embodiment of the bag. Bag 78 includes a handle 80, a top wall 82, sidewalls 84, 86, end walls 88, 90, and a bottom 92. The bag 78 is like bag 10 except that the opposite side portions of the handle 80 are integral with each other at the top of the bag, owing to a different method of manufacturing the bag 78.

Referring to FIG. 13, a single wide web 94 of a thermoplastic material is fed off of a storage roll 96. It is then folded laterally on itself, by use of a V-board, or the like, to create an upper bag panel 98 and a lower bag panel 100, connected together at an upper boundary by fold line 102. The unattached edges of the panels 98, 100 form a lower boundary. Panel 100 is slightly wider than panel 98 so as to form a lip 104 for receiving the wicket pin openings 106. According to the invention, a gusset web 108 is moved off from a storage roll 110 and is folded on itself to form a folded gusset web 112. The folded gusset web 112 comprises a first web section 114 connected to a second web section 116 by a bight 118. The folded web 112 is introduced between the bag panel webs 98, 100, with the unattached edges of the gusset web 112 directed towards the fold line 102. The two webs 98, 100, 112 are then guided through a heat seal station whereat upper and lower heat seal devices function to connect the free edge portions of the folded gusset web 112 to adjacent portions of the bag panel webs 98, 100, at locations 120, 122. As in the first embodiment, the heat sealing can be done by hot air heat sealers, impact bar sealers, or the like. Following the joining of the gusset web 112 to the bag panels 98, 100, the handle portion of the folded web 94, outwardly of the heat seals 120, 122, is suitably cut to form the desired handle. Then, the wicket pin openings 106 are punched and a delineated bag is cut free from the downstream end portion of the connected webs, in the manner discussed above in connection with the manufacture of a first embodiment.

Figure 14:
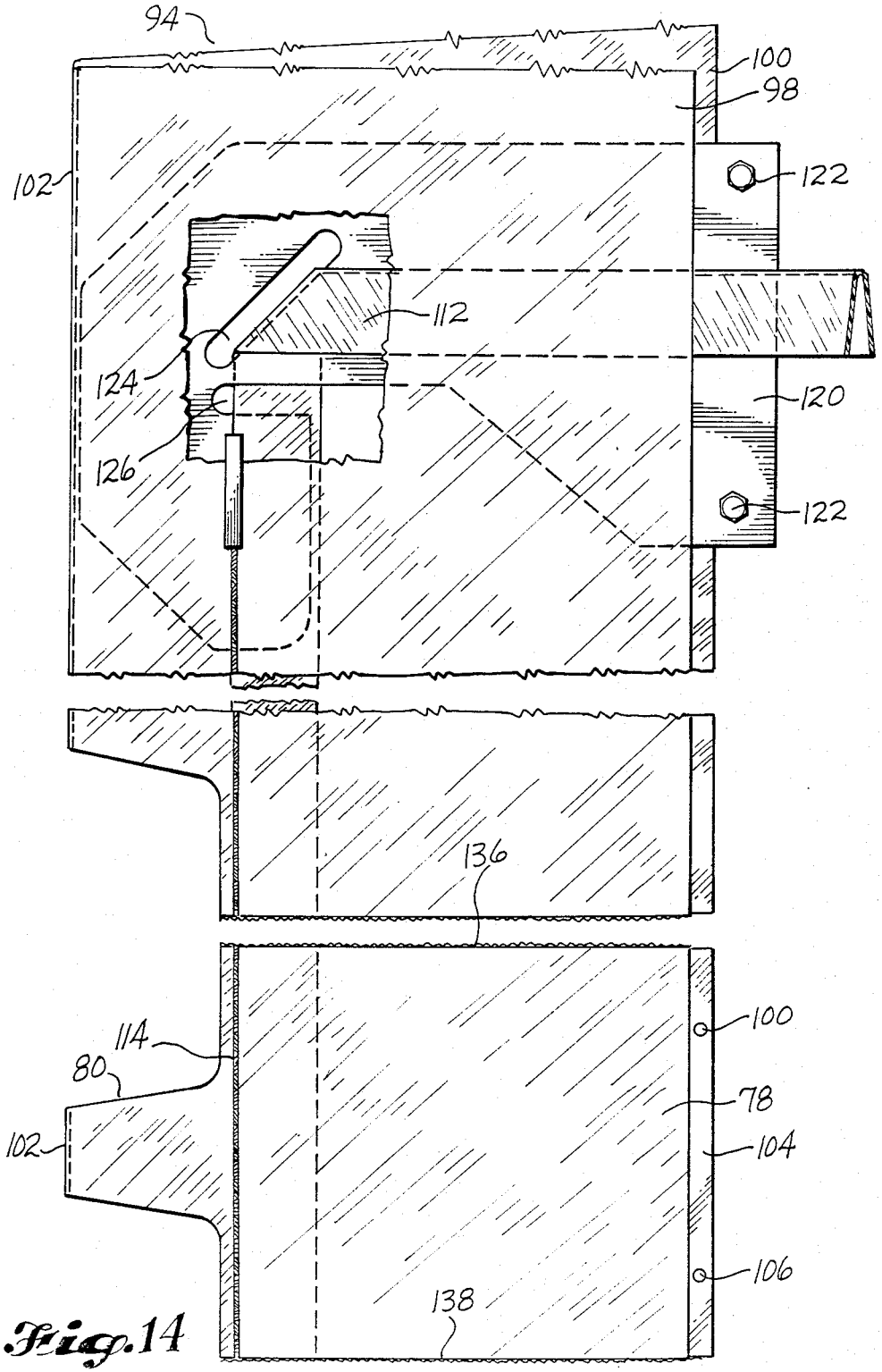
FIG. 14 is a fragmentary top plan view of the bag and panel webs and an embodiment of equipment used for heat welding them together.

FIGS. 14–17 illustrate an example embodiment of equipment for positioning the folded gusset web 112 between the bag panels 98, 100. A plate member 120 may be used which at its outer end is attached to a portion of the machine frame, such as by bolts 122 (FIGS. 14 and 15). The plate 120 extends between the bag panels 98, 110 over to the closed boundary of the web 94, where the fold line 102 is formed. Plate 120 may include a diagonal guide slot 124 and a transverse transition slot 126. The folded gusset web 112 initially extends perpendicular to the direction of travel of the web 94 through the machine. It extends over the plate 120 and then down through the diagonal slot 124. The diagonal slot 124 reorients the folded web 112, causing it to now extend in the same direction as the web 94, i.e. longitudinally of the machine. As shown in FIG. 17, the transition slot 124 allows the upper web section 114 to be moved into a position above an anvil 128. Anvil 128 is a portion of the plate 120. The lower web section 116 remains below the anvil 128. The outer boundary 130 of plate 120 may include a rounded edge 130. Edge 130 may be provided with a low friction surface or may be constructed in the form of an air bearing, for minimizing friction between it and the web 94 at the fold 102. As shown by FIG. 17, the anvil 128 permits gusset web section 114 to be attached to bag panel 98 and gusset web section 116 to be attached to bag panel 100, while preventing all four sections 98, 100, 114, 116 from being heat sealed together. In the drawing figures hot air sealers 132, 134, are shown by way of an example. As shown by FIGS. 15 and 16, the plate 120 may be provided with raised and rounded ridge portions 136, 138 which have low friction upper surfaces and function to rais the bag panel 98 up slightly so that it is above the portion of the folded gusset web 112 which is extending perpendicular to the web 94.

FIG. 14 shows a bag 78 at the output end of the machine. The bag 78 is in a flat condition and includes side seams 136, 138. The bag 78 is identical to bag 10 except for the upper end of the two handles 24, 80. As previously described, the upper end portions 50, 52 of the bag panel portions 62, 64 are connected together by a heat seal 54. In bag 78, the portions 140, 142 of the bag panels 98, 100 which extend between the heat seals 114, 116 and the fold line 102 are connected together by and at the fold line 102.

For economical reasons it is preferred that the bag be constructed from polyethylene. However, other types of thermoplastic materials, capable of being heat sealed together, can be used.

Figure 8:
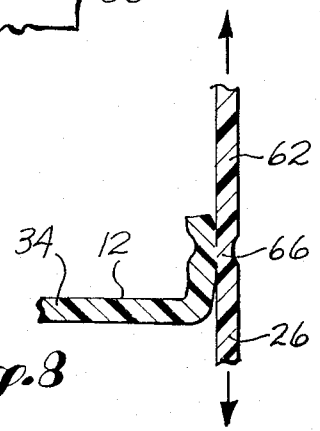
FIG. 8 is an enlarged scale fragmentary sectional view in the vicinity of the heat weld between the false gusset and a side panel of the bag.
Figure 9:
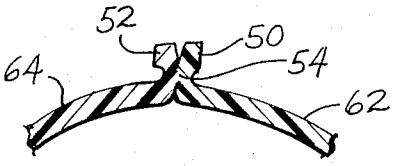
FIG. 9 is an enlarged scale fragmentary sectional view in the vicinity of the heat seal at the upper boundary of the handle region of the bag side panels.

An advantage of both of the bags 10, 78 is that the carrying handle 24, 78 is constructed from panels which are an upward continuation of the sidewalls 14, 16 of the bags 10, 78. As shown in FIG. 8, the weight of the bag and its contents put the sidewall material in tension. The top wall 12 (82 in bag 78) does not carry any of the stresses. As a result, the heat seals 66, 68 in bag 10 and the heat seals 114, 116 in bag 78 are less critical (some flaws can be tolerated) than they would be in a bag in which the weight of the bag and its contents must be transferred through the heat seals to the handle. Also, the attached portions of the false gussets 12, 82 are positioned inside of the bag material, substantially hiding the edge from view when the package is on a shelf in the store. This construction gives the package an overall neater appearance than a package with an add-on handle. As previously explained, the add-on handle has an exterior skirt which depends from the seal which connects the handle to the bag and in that region becomes pleated, adversely affecting its appearance.

The integral nature of the handle parts with the sidewalls of the bag also make it possible for the printing to be continued up into the handle region. Also, the false gusset 12, 82 can be constructed from a transparent material, or a transparent material which has been printed to make it opaque except in a selected window area.

The gusset 12, 82 may be provided with some sort of weakened region or easy opening structure, such as a line of perforations 83, or it may be left plain, to discourage unauthorized entry into the bag through the gusset region. The gusset web can be made stronger than the bag web(s) to resist tearing of the top. If perforations or some other easy open structure is used, it may extend either lengthwise or crosswise of the gusset 12, 82 or define an opening shape.

As is well known per se, the goods (e.g. folded disposable diapers) are introduced into the open end of the bag, opposite the gusset 12, 82. Then, such open end is heat sealed shut, to form the bag into a carton-like package. This allows the bag 10, 78 to be stacked, either in a vertical orientation or a horizontal orientation. The bag panels 26, 28 and 98, 100 may be constructed from a laminated plastic material. This material (FIG. 18) has an opaque inner layer 150 which is printed and a transparent outer layer 152 which is bonded to the printed inner layer and functions to protect the printing against scuffing. This is per se well known and has been in use for process packaging of all types for a good number of years.

An advantage of the first bag design is that the bag webs 26, 28 can be separately printed. This allows the printing to be done on a machine with a width capacity substantially equal to the width of webs 26, 28.

The disclosed embodiment of both the bag and the method aspects of the invention are presented by way of example only. The scope of protection is not to be directly limited by these embodiments but only by the appended claims, interpreted in accordance with established rules of patent claim interpretation, including application of the doctrine of equivalents.

What is claimed is:

1. A handle bag, comprising:

first and second panels of flexible thermoplastic material overlying one another and together presenting an upper boundary and a lower boundary;

a web of thermoplastic material folded on itself, to form two web sections joined by a bight, and two edges near each other opposite the bight, said folded web being positioned between the two panels, with the bight of the folded web directed towards the lower boundary of the panels and the edges of the folded web spaced from the upper boundary of the panels a distance at least as large as the folded width of the web;

a heat seal on each side of the bag connecting an edge portion of each web section to an adjoining portion of the adjacent panel, to connect the web edge portions to the panels along lines which extend parallel to the bight and edges of the web and also parallel to the upper and lower boundaries of the panels;

heat seals sealing the panels and folded web together along spaced apart lines which extend parallel to each other and perpendicular to the bight and edges of the folded web and also perpendicular to the upper and lower boundaries of the panels, to form bag side seals which connect together the two sections of the folded web and the adjoining portions of the two panels, in the region where the folded web is between the two panels, and which also connect the two panels together in the regions of the panels which extend between the bight of the folded web and the lower boundary of the panels;

said panels being connected to each other and to the folded web by the heat seals in a manner so that the bag when filled can approximate the shape of a hexahedron with the web unfolded to form a closed top for the bag;

said panels being connected together at the upper boundary of the panels; and wherein the portions of the panels that are located between the upper boundary of the panels and the heat seals which connect the web to the panels form a handle which extends over the closed top of the bag from one side of the bag to the other.

2. A handle bag according to claim 1, wherein the first and second panels of flexible thermoplastic material are separate members and at the upper boundary of the panels are connected together by a heat seal.

3. A handle bag according to claim 1, wherein the first and second panels of flexible thermoplastic material are constructed from a single piece of material and are integral in one piece where they meet at the upper boundary of the panels.

4. A handle bag according to claim 1, wherein the first and second panels of flexible thermoplastic material are each a laminate and each comprises an inner layer which is opaque with printing on its outer surface, and an outer layer which is transparent and is bonded to the printed surface of the inner layer, to both protect the inner layer and add strength to the bag and handle.

5. A handle bag according to claim 4, wherein the web is constructed to be stronger than the first and second panels, to resist tearing of the top.

6. A handle bag according to claim 1, wherein the web is constructed to be stronger than the first and second panels, to resist tearing of the top.

7. The handle bag according to claim 1, wherein the web is constructed to be weaker than the first and second panels, to facilitate opening of the top to provide access to the contents of the bag.

8. A handle bag according to claim 7, wherein the web is provided with a weakened region to facilitate the formation of an access opening in the top.

9. A handle bag according to claim 1, wherein the portions of the panels that are located between the upper boundary of the panels and the heat seals which connect the web to the panels form a handle which at the upper boundary of the panels is spaced vertically above the closed top of the bag, to define a tunnel opening vertically between said handle and the closed top of the bag, extending longitudinally of the closed top end through which a person's arm may be inserted.

10. A handle bag according to claim 9, wherein the first and second panels of flexible thermoplastic material are separate members and at the upper boundary of the panels are connected together by a heat seal.

11. A handle bag according to claim 9, wherein the first and second panels of flexible thermoplastic material are constructed from a single piece of material and are integral in one piece at the upper boundary of the panels.

12. A handle bag according to claim 1, wherein at least a portion of the web of thermoplastic material is transparent so that goods in the bag can be viewed through it.

13. A handle bag according to claim 1, wherein at the sides of the bag the edge portions of said web turn upwardly in a side lapping relationship to the panels, on the inside of the panels, and the panels above the web are sculptured to form a handle which is adjacent the web, is as wide as the panels and then narrows as it extends upwardly from its base to the upper boundary of the panels.

14. A handle bag according to claim 13, wherein the first and second panels of flexible thermoplastic material are separate members and at the upper boundary of the panels are connected together by heat seal.

15. A handle bag according to claim 13, wherein the first and second panels of flexible thermoplastic material are constructed from a single web of material and are integral in one piece at the upper boundary of the panels.

* * * * *